US006104364A

United States Patent [19]

Hayashi

[11] Patent Number: 6,104,364

[45] Date of Patent: Aug. 15, 2000

[54] DEVICE FOR REDUCING OUTPUT DEVIATION IN LIQUID CRYSTAL DISPLAY DRIVING DEVICE

[75] Inventor: Tomoaki Hayashi, Tokyo, Japan

[73] Assignee: NEC Corporation, Tokyo, Japan

[21] Appl. No.: 09/084,824

[22] Filed: May 26, 1998

[30] Foreign Application Priority Data

May 27, 1997 [JP] Japan ..... 9-136885

[51] Int. Cl.[7] ..... G09G 3/36

[52] U.S. Cl. ..... 345/87

[58] Field of Search ..... 345/87, 88, 97, 345/98

[56] References Cited

U.S. PATENT DOCUMENTS

| | | | |
|---|---|---|---|
| 5,483,256 | 1/1996 | Ohi | 345/98 |
| 5,604,511 | 2/1997 | Ohi | 345/98 |
| 5,682,175 | 10/1997 | Kitamura | 345/98 |
| 5,734,366 | 3/1998 | Kubota et al. | 345/98 |
| 5,748,167 | 5/1998 | Watanabe et al. | 345/98 |

FOREIGN PATENT DOCUMENTS 1-167794 7/1989 Japan .

8-263013 10/1996 Japan .

*Primary Examiner*—Richard A. Hjerpe
*Assistant Examiner*—Ronald Laneau
*Attorney, Agent, or Firm*—Ostrolenk, Faber, Gerb & Soffen, LLP

[57] ABSTRACT

In a liquid crystal display driving device, a compare circuit compares input pixel data with pixel data delayed by a clock cycle and generates a discrimination signal indicative of whether or not the input pixel data is coincident with the delayed pixel data. A liquid crystal display driving circuit receives the input pixel data and includes output amplifiers for outputting parallel driving signals to output terminals connected to a liquid crystal display. A group of switches are connected between the output amplifiers and the output terminals. The switches are controlled by a switch control circuit based on the discrimination signal in such a manner that when the discrimination signal indicates that the input pixel data is coincident with the one-clock-delayed pixel data, the output terminal corresponding to the one-clock-delayed pixel data is short circuited to the output terminal corresponding to the delayed pixel data, so that the driving signals supplied to the two output terminals are equalized to reduce an output deviation in the driving signals supplied to the liquid crystal display.

6 Claims, 3 Drawing Sheets

DEVICE FOR REDUCING OUTPUT DEVIATION IN LIQUID CRYSTAL DISPLAY DRIVING DEVICE

BACKGROUND OF THE INVENTION

1. Field of the Invention

The present invention relates to a liquid crystal display driving device, and more specifically to a device for reducing an output deviation in a liquid crystal display driving device.

2. Description of Related Art

Referring to FIG. 1, there is shown a block diagram of a prior art liquid crystal display driving device, in which analog video data supplied through a video signal input terminal 15 is converted into digital data by an A/D (analog-to-digital) converter 17, and then, inputted into a ROM table 18. This ROM table 18 carries out a so-called γ-compensation (gamma compensation) by adding the inputted digital data with a previously measured or calculated output deviation compensating component. The γ-compensated data is supplied to a liquid crystal display drive circuit comprising a shift register 20, a latch circuit 21 and a D/A (digital-to-analog) converter 22 which are controlled by a latch signal supplied from a latch signal input terminal 16, and also through a group of output amplifiers 23 to a group of output terminals 19 which are connected to a liquid crystal display.

The liquid crystal display driving device utilizing the γ-compensation is disclosed by, for example, Japanese Patent Application Pre-examination Publication No. JP-A-1-167794 and U.S. Pat. Nos. 5,483,256 and 5,604,511, the contents of which are incorporated by reference in its entirety into this application. Also, an English abstract of JP-A-1-167794 is available from the Japanese Patent Office and the content of the English abstract of JP-A-1-167794 is also incorporated by reference in its entirety into this application.

In the above mentioned liquid crystal display driving device, since the ROM table is used, and since the γ-compensation of the data is executed for each output terminal, the compensation table data is required for all the output terminals. In a multi-output driving device, therefore, a large-capacity ROM becomes necessary. In addition, since the output deviation is different from one liquid crystal display driving device to another because of variation in a manufacturing process, it is necessary to write a large amount of compensating coefficients into the ROM for each liquid crystal display driving device, and therefore, the ROM is required to have a large capacity. Furthermore, since the compensating coefficients written into the ROM have already become fixed, it is no longer possible to comply with change in temperature or a change-with-time of the liquid crystal display driving device and the liquid crystal display, such as a power supply voltage variation in the liquid crystal display driving device.

SUMMARY OF THE INVENTION

Accordingly, it is an object of the present invention to provide a device for reducing an output deviation in a liquid crystal display driving device, which has overcome the above mentioned defect of the conventional device.

Another object of the present invention is to provide a device for reducing an output deviation in a liquid crystal display driving device, capable of compensating the output deviation, with no large-capacity ROM, and while complying with change in temperature or a change-with-time such as a power supply voltage variation.

The above and other objects of the present invention are achieved in accordance with the present invention by a liquid crystal display driving device comprising:

a discriminating means receiving an input pixel data for comparing the input pixel data with a preceding pixel data just before the input pixel data, and generating a discrimination signal indicative of whether or not the input pixel data is coincident with the preceding pixel data, a liquid crystal display driving circuit receiving the input pixel data and including output amplifiers for outputting parallel driving signals to output terminals connected to a liquid crystal display; and a switch circuit means connected between the output amplifiers and the output terminals, and controlled by the discrimination signal to short-circuit the output terminal corresponding to the input pixel data and the output terminal corresponding to the preceding pixel data when the discrimination signal indicates that the input pixel data is coincident with the preceding pixel data so that the driving signals supplied to the two output terminals are equalized to reduce an output deviation in the driving signals supplied to the liquid crystal display.

The above and other objects, features and advantages of the present invention will be apparent from the following description of a preferred embodiment of the invention with reference to the accompanying drawings.

DESCRIPTION OF THE PREFERRED EMBODIMENT

Figure 1:
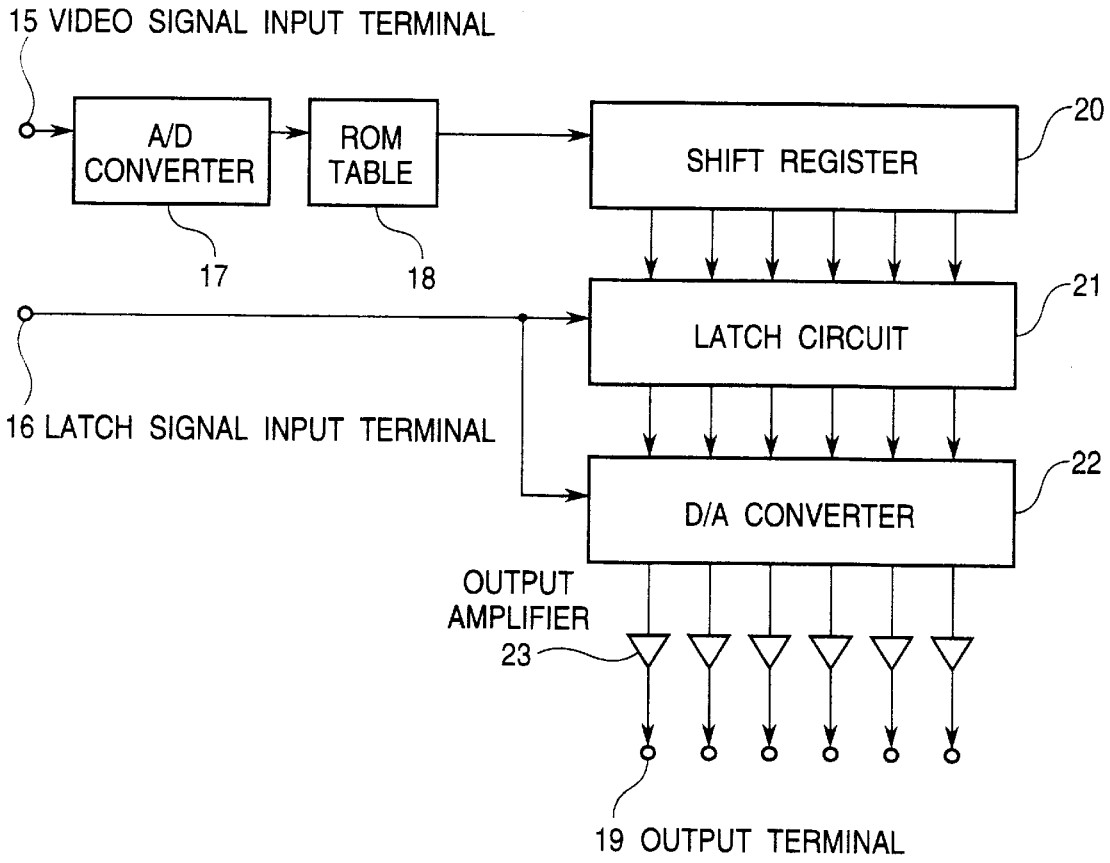
Fig. 1 PRIOR ART
FIG. 1 is a block diagram of a prior art liquid crystal display driving device.
Figure 2:
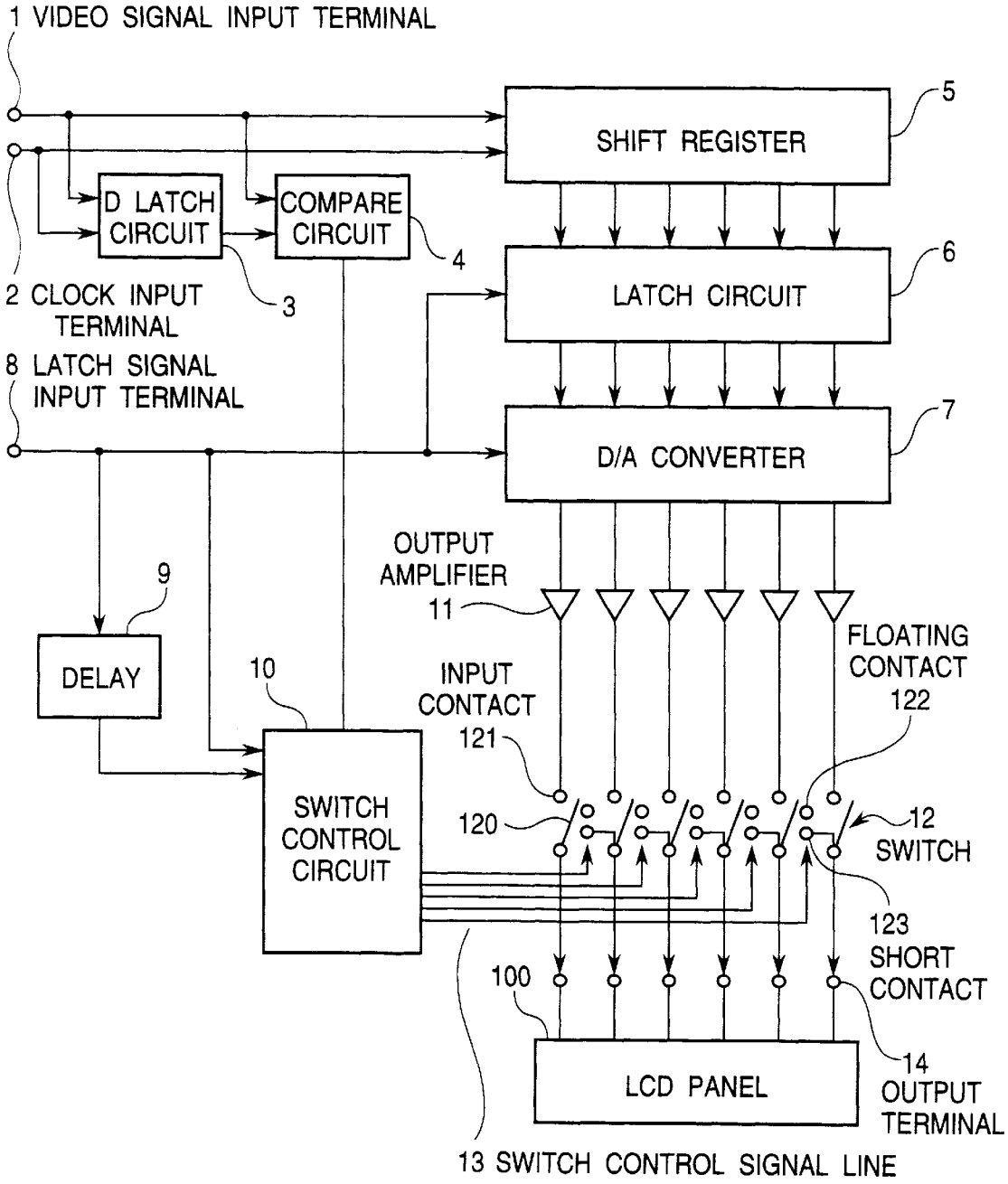
FIG. 2 is a block diagram of one embodiment of the liquid crystal display driving device in accordance with the present invention.

Referring to FIG. 2, there is shown a block diagram of one embodiment of the liquid crystal display driving device in accordance with the present invention.

The shown embodiment includes a video signal input terminal 1 for receiving digital video data, a clock input terminal 2 for receiving a clock signal, and a D-latch circuit 3 connected to the video signal input terminal 1 and the clock input terminal 2 for latching the digital video data in response to the clock signal so as to output the digital video data delayed by one clock. A compare circuit 4 is connected to the video signal input terminal 1 and an output of the D-latch circuit 3. A shift register 5 is connected to the video signal input terminal 1 and the clock input terminal 2 for latching and shifting the digital video data in response to the clock signal.

The shown embodiment also includes a latch signal input terminal 8 for receiving a latch signal. A latch circuit 6 is connected to parallel outputs of the shift register 5 and the latch signal input terminal 8 to latch the parallel outputs of the shift register 5 in response to the latch signal. A D/A (digital-to-analog) converter 7 is connected to parallel outputs of the latch circuit 6 and the latch signal input terminal 8 to digital-to-analog convert the parallel outputs of the latch circuit 6 in response to the latch signal. Parallel outputs of the D/A converter 7 are supplied through a group of output amplifiers 11 and a corresponding number of switches 12 to a corresponding number of output terminals 14, which are connected to a LCD (liquid crystal display) panel 100 as horizontal driver signals corresponding to one horizontal scan line. The latch signal input terminal 8 is connected through a latch signal delay circuit 9 to a switch control circuit 10, which also receives the latch signal directly from the latch signal input terminal 8 and an output of the compare circuit 4, and controls the switches 12 through switch control signal lines 13.

Now, an operation of the shown embodiment will be described with reference to the timing chart of FIG. 3.

Digital video data for writing an image into the LCD panel 100 is serially supplied through the video signal input terminal 1 to the shift register 5, and shifted within the shift register 5 in response to the clock signal supplied through the clock input terminal 2, so that the serial digital video data is converted into a parallel digital video data by the shift register 5. When the digital video data of the amount corresponding to one scan line are fetched in the shift register 5, the latch signal supplied through the latch signal input terminal 8 is activated so that the parallel digital video data outputted from the parallel outputs of the shift register are latched into the latch circuit 6 in parallel. Then the D/A converter 7 digital-to-analog converts the parallel digital video data outputted from the latch circuit 6, to a corresponding number of parallel analog video data. The corresponding number of output amplifiers 11 receive and amplify the parallel analog video signals outputted from the D/A converter 7, to output a corresponding number of amplified parallel analog video signals to the corresponding number of switches 12.

Figure 3:
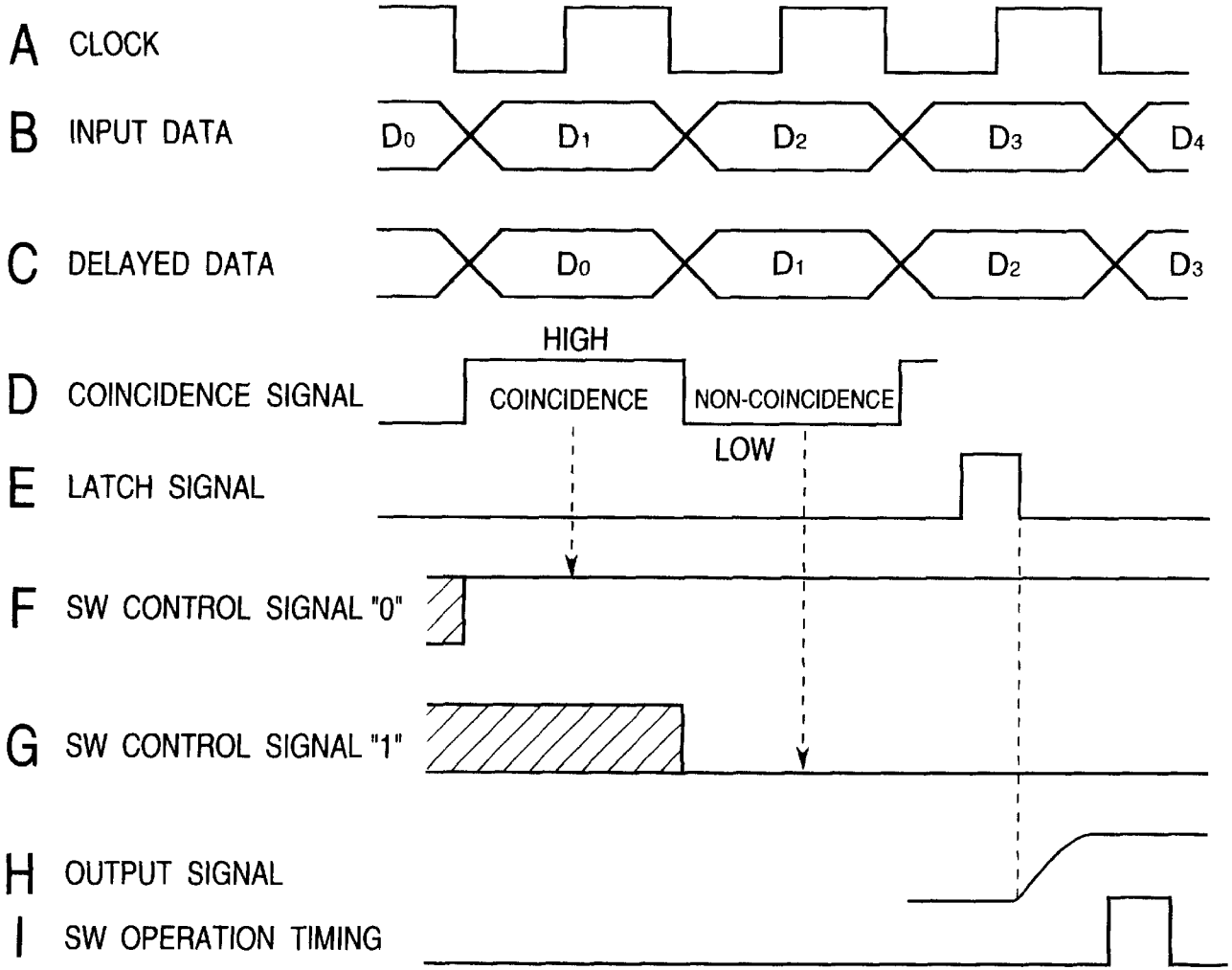
FIG. 3 is a timing chart illustrating an operation of the liquid crystal display driving device shown in FIG. 2.

On the other hand, the D-latch circuit 3 receives the clock signal, as shown in "A" of FIG. 3, supplied through the clock input terminal 2, and the digital video data, as shown in "B" of FIG. 3, supplied through the video signal input terminal 1, and outputs delayed digital video data, as shown in "C" of FIG. 3, which is delayed from the input digital video data by one clock. The compare circuit 4 receives and compares the input digital video data, as shown in "B" of FIG. 3 and the delayed digital video data, as shown in "C" of FIG. 3. For example, assuming that the input digital video data $D_1$ shown in "B" of FIG. 3 is coincident with the one-clock-delayed digital video data $D_0$ shown in "C" of FIG. 3, the compare circuit 4 outputs a coincidence signal of a logical high level, as shown in "D" of FIG. 3. Assuming that the input digital video data $D_2$ shown in "B" of FIG. 3 is not coincident with the one-clock-delayed digital video data $D_1$ shown in "C" of FIG. 3, the compare circuit 4 outputs the coincidence signal of a logical low level, as shown in "D" of FIG. 3. This compare circuit 4 can be formed of an exclusive-OR circuit.

The latch signal delay circuit 9 receives the latch signal as shown in "E" of FIG. 3 through the latch signal input terminal 8, and delays the latch signal by a time corresponding to a time in which the output signals of the amplifiers 11 complete the charging of the electrodes of the LCD panel, as shown in "H" of FIG. 3. Each of the switches 12 includes a movable contact 120 connected to a corresponding output terminal 14, an input stationary contact 121 connected to the output of a corresponding output amplifier 11, a floating stationary contact 122 maintained in a floating condition, and a short-circuiting stationary contact 123 connected to the movable contact 120 of an adjacent switch which receives the digital video data preceding by one clock.

The switch control circuit 10 receives the coincidence signal generated by the compare circuit 4, and generates a switch control signal "0" as shown in "F" of FIG. 3 when the switch control circuit 10 receives the coincidence signal of the high level, and a switch control signal "1", as shown in "G" of FIG. 3 when the switch control circuit 10 receives the coincidence signal of the low level (non-coincidence). The switch control circuit 10 temporarily holds the generated switch control signals by the amount corresponding to one scan line.

In response to the latch signal as shown in "E" of FIG. 3 (falling edge), the switch control circuit 10 controls the associated switches 12 to couple the movable contact 120 to the input stationary contact 121 in all the switches 12 so that the respective analog video signals outputted from the amplifiers 11 are supplied through the output terminals 14 to the corresponding electrodes of the LCD panel 100 to charge the corresponding electrodes of the LCD panel 100. Thereafter, in response to the delayed latch signal (namely, when the charging of the electrodes of the LCD panel has been completed), on the basis of the temporarily held switch control signals the switch control circuit 10 controls the associated switches 12 to couple the movable contact 120 to the short-circuiting stationary contact 123 in the switches corresponding to the switch control signal "0", and to contact the movable contact 120 to the floating stationary contact 122 in the switches corresponding to the switch control signal "1".

Under the above mentioned assumption, since the data $D_0$ and $D_1$ are coincident, in the switch 12 supplied with the analog signal corresponding to the digital video data $D_1$, the movable contact 120 is contacted to the short-circuiting stationary contact 123 so that the output terminal 14 supplied with the analog signal corresponding to the digital video data $D_0$ and the output terminal 14 supplied with the analog signal corresponding to the digital video data $D_1$ are short-circuited by that switch 12 (which is controlled by the switch control signal "0"). On the other hand, in the switch 12 supplied with the analog signal corresponding to the digital video data $D_2$, the movable contact 120 is contacted to the floating stationary contact 122 so that the output terminal 14 supplied with the analog signal corresponding to the digital video data $D_2$ is put in a floating condition by the switch 12 (which is controlled by the switch control signal "1") so that the output terminal 14 supplied with the analog signal corresponding to the digital video data $D_1$ and the output terminal 14 supplied with the analog signal corresponding to the digital video data $D_2$ are isolated from each other.

Thus, when the driving signals applied to adjacent output terminals (namely, adjacent electrodes of the LCD panel) are the same pixel data, the adjacent output terminals (namely, adjacent electrodes of the LCD panel) are short-circuited. On the other hand, when the driving signals applied to adjacent output terminals (namely, adjacent electrodes of the LCD panel) are not the same pixel data, the adjacent output terminals (namely, adjacent electrodes of the LCD panel) are maintained in a floating condition isolated from each other. Therefore, the driving voltages of the adjacent electrodes of the LCD panel driven with the same pixel data are equalized, with the result that the output data supplied for driving the LCD panel are equalized, and therefore, an output deviation having a special level is suppressed.

As seen from the above, when the data for one pixel and the data for a next pixel adjacent to the one pixel are the same, the output terminal for the one pixel and the output terminal for the next pixel adjacent to the one pixel are short-circuited, so that the outputs of the output amplifiers connected to the output terminals are equalized, namely, the output deviation between the output amplifiers connected to the output terminals is reduced. Therefore, the data table for compensating the data for each output terminal becomes unnecessary, and even in a multi-output driving device, a large-capacity ROM is not required for compensating the data for each output terminal. Accordingly, even if the output deviation is different from one liquid crystal display driving device to another because of variation in a manufacturing process, it is no longer necessary to write a large amount of compensating coefficients into the ROM for each liquid crystal display driving device. In addition, since it is not necessary to write the compensating coefficients into the ROM, the compensation data is not fixed, and therefore, it is possible to easily comply with change in temperature or a change-with-time such as a power supply voltage variation, thereby to reduce the output deviation.

The invention has thus been shown and described with reference to the specific embodiments. However, it should be noted that the present invention is in no way limited to the details of the illustrated structures but changes and modifications may be made within the scope of the appended claims.

What is claimed is:

1. A liquid crystal display driving device comprising:

a comparator circuit which compares input pixel data and preceding input pixel data, said preceding input pixel data being said input pixel data delayed by a clock cycle, said comparator circuit generating a discrimination signal, in response to said comparison, indicative of whether said input pixel data is coincident with said preceding input pixel data;

a liquid crystal display driving circuit which receives said input pixel data and outputs driving signals to a liquid crystal display through output terminals coupled to said liquid crystal display; and a switch control circuit connected to said liquid crystal display driving circuit, said switch control circuit being controlled by said discrimination signal to short-circuit a first output terminal having data corresponding to said input pixel data and a second output terminal having data corresponding to said preceding input pixel data when said discrimination signal indicates that said input pixel data is coincident with said preceding input pixel data.

2. The liquid crystal display driving device as claimed in claim 1, wherein said comparator circuit comprises:

a first delay circuit which receives said input pixel data and a clock signal and outputs as said preceding input pixel data, said input pixel data delayed by one clock signal;

a comparator which compares said input pixel data with said preceding input pixel data said comparator generating said discrimination signal.

3. The liquid crystal display driving device as claimed in claim 2, further comprising:

a plurality of switches coupled to said output terminals, each respective switch being movable among a first position where a respective output terminal receives a respective driving signal, a second position where said respective switch is shorted to an adjacent switch, and a third position where said respective switch is at neither said first nor said second positions, wherein a first one of said switches couples said input pixel data to said first output terminal when said first switch is in said first position, a second one of said switches couples said preceding input pixel data to said second output terminal when said second switch is in said first position; and wherein said switch control circuit receives said discrimination signal outputted from said comparator circuit and receives a latch signal supplied through a latch signal input terminal, said switch control circuit controls said plurality of switches so that:

in response to said latch signal, said switches are moved to said first position, when said discrimination signal indicates that said input pixel data is coincident with said preceding input pixel data, one of said first and second switches is moved to said second position whereby said first switch is shorted to said second switch so that said driving signals supplied to said first and second output terminals are equalized, and when said discrimination signal indicates that said input pixel data is not coincident with said preceding input pixel data, said one of said first and second switches is moved to said third position.

4. The liquid crystal display driving device as claimed in claim 3, further comprising:

a second delay circuit which receives said latch signal and outputs a delayed latch signal delayed by a time which allows for the charging of an electrode of said liquid crystal display to be completed; and wherein when said discrimination signal indicates that said input pixel data is coincident with said preceding input pixel data, in response to said delayed latch signal, said switch control circuit moves said one of said first and second switches to said third position.

5. A method of controlling a liquid crystal display driving device including a liquid crystal display having output terminals effective to receive driving signals to drive said liquid crystal display, said method comprising the acts of:

receiving input pixel data;

comparing said input pixel data with previous input pixel data thereby producing a discrimination signal indicative of whether said input pixel data is coincident with said previous input pixel data; and shorting a first output terminal containing data corresponding to said input pixel data with a second output terminal containing data corresponding to said previous input pixel data when said discrimination signal indicates that said input pixel data is coincident with said previous input pixel data.

6. The method as claimed in claim 5, further comprising the act of isolating said first and second output terminals from each other when said discrimination signal indicates that said input pixel data is not coincident with said previous input pixel data.

* * * * *